US011373828B2

(12) United States Patent
Kato et al.

(10) Patent No.: US 11,373,828 B2
(45) Date of Patent: Jun. 28, 2022

(54) ELECTROMAGNETIC RELAY AND CONTROL METHOD THEREOF

(71) Applicant: Panasonic Intellectual Property Management Co., Ltd., Osaka (JP)

(72) Inventors: Akira Kato, Osaka (JP); Kazuyuki Sakiyama, Osaka (JP); Takehiko Yamakawa, Osaka (JP); Motohiko Fujimura, Kanagawa (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 49 days.

(21) Appl. No.: 17/040,966

(22) PCT Filed: Feb. 12, 2019

(86) PCT No.: PCT/JP2019/004899
§ 371 (c)(1),
(2) Date: Sep. 23, 2020

(87) PCT Pub. No.: WO2019/181274
PCT Pub. Date: Sep. 26, 2019

(65) Prior Publication Data

US 2021/0217571 A1 Jul. 15, 2021

(30) Foreign Application Priority Data

Mar. 23, 2018 (JP) ..... JP2018-057213

(51) Int. Cl.
*H01H 50/42* (2006.01)
*H01H 50/20* (2006.01)
*H01H 50/54* (2006.01)

(52) U.S. Cl.
CPC ..... *H01H 50/42* (2013.01); *H01H 50/20* (2013.01); *H01H 50/54* (2013.01)

(58) Field of Classification Search
CPC ..... H01H 50/20; H01H 50/42; H01H 50/54; H01H 50/16
See application file for complete search history.

(56) References Cited

U.S. PATENT DOCUMENTS 4,489,360 A * 12/1984 Kraicar ..... H04B 3/44 361/187
4,686,380 A * 8/1987 Angott ..... G08C 17/02 307/125

(Continued)

FOREIGN PATENT DOCUMENTS

JP H02-220322 A 9/1890
JP S52-49839 U 4/1977

(Continued)

OTHER PUBLICATIONS

Machine Translation of JPS62140330A (Year: 1987).*

(Continued)

*Primary Examiner* — Bernard Rojas
(74) *Attorney, Agent, or Firm* — McDermott Will & Emery LLP

(57) ABSTRACT

An electromagnet device moves two moving contacts from one of a closed position or an open position to the other position when an electric current flows through a coil. A regenerative current coming from the coil flows through a regeneration unit when the coil makes a transition from an energized state where the coil is supplied with an electric current from a power supply to a non-energized state where the coil is supplied with no electric current from the power supply. The control unit causes the regenerative current to flow through a load by controlling a switch when the coil makes the transition from the energized state to the non-energized state.

5 Claims, 5 Drawing Sheets

(56) References Cited

U.S. PATENT DOCUMENTS

| | | | | |
|---|---|---|---|---|
| 2012/0018404 | A1* | 1/2012 | Matsuo | H01H 9/548 218/8 |
| 2013/0021121 | A1* | 1/2013 | Uchida | H01H 51/065 335/131 |
| 2016/0301235 | A1* | 10/2016 | Okanoue | H02H 11/003 |
| 2018/0277324 | A1 | 9/2018 | Kobayashi | |

FOREIGN PATENT DOCUMENTS

| | | | |
|---|---|---|---|
| JP | S62-140330 | A | 6/1987 |
| JP | 2012-142208 | A | 7/2012 |
| JP | 2013-209986 | A | 10/2013 |
| JP | 2017-16908 | A | 1/2017 |

OTHER PUBLICATIONS

Internatianal Search Report issued in corresponding International Patent Application No. PCT/JP2019/004899, dated Apr. 2, 2019, with English translation.

Japanese Office Action dated Nov. 24, 2021, for the corresponding Japanese patent application No. 2020-507421, with English translation.

* cited by examiner

ELECTROMAGNETIC RELAY AND CONTROL METHOD THEREOF

CROSS-REFERENCE OF RELATED APPLICATIONS

This application is the U.S. National Phase under 35 U.S.C. § 371 of International Patent Application No. PCT/JP2019/004899, filed on Feb. 12, 2019, which in turn claims the benefit of Japanese Application No. 2018-057213, filed on Mar. 23, 2018, the entire disclosures of which Applications are incorporated by reference herein.

TECHNICAL FIELD

The present disclosure generally relates to an electromagnetic relay and a control method thereof. More particularly, the present disclosure relates to an electromagnetic relay designed to move a moving contact by having a magnetic flux generated by a coil and a method for controlling the electromagnetic relay.

BACKGROUND ART

Patent Literature 1, for example, discloses a known electromagnetic relay. The electromagnetic relay of Patent Literature 1 includes an excitation coil, a mover, a stator, a return spring, and a contact device. While the excitation coil is not energized (i.e., supplied with no electric current), no magnetic attractive force is produced between the mover and the stator. Thus, in such a situation, the mover is located at a second position under the spring force applied by the return spring. On the other hand, when the excitation coil is energized, magnetic attractive force is produced between the mover and the stator, and therefore, the mover moves to a first position by overcoming the spring force applied by the return spring. The contact device includes a pair of fixed contacts and a pair of moving contacts. When the mover contacts with the stator as a result of the movement of the moving contacts set up by its own movement, the contact device makes a transition to a closed state where the moving contacts are in contact with the fixed contacts. On the other hand, when the mover goes out of contact with the stator as a result of the movement of the moving contacts set up by its own movement, the contact device makes a transition to an open state where the moving contacts are out of contact with the fixed contacts.

In the electromagnetic relay of Patent Literature 1, even when a transition is made from a state where an electric current is supplied from an excitation power supply to the excitation coil (coil) to a state where no electric current is supplied from the power supply to the excitation coil, a regenerative current is still generated by self-induction in the excitation coil. A magnetic flux generated by the regenerative current produces force in such a direction as to cause the mover to move from a second position to a first position. This could interfere with the mover's movement from the first position toward the second position.

CITATION LIST

Patent Literature

Patent Literature 1: JP 2017-016908 A

SUMMARY OF INVENTION

It is therefore an object of the present disclosure to provide an electromagnetic relay and a control method thereof, both of which are configured or designed to more quickly reduce the regenerative current generated by the coil.

To overcome this problem, an electromagnetic relay according to an aspect of the present disclosure includes: a fixed contact; a moving contact; an electromagnet device; a regeneration unit; and a control unit. The moving contact is movable from a closed position where the moving contact is in contact with the fixed contact to an open position where the moving contact is out of contact with the fixed contact, and vice versa. The electromagnet device includes a coil. The electromagnet device moves the moving contact from one of the closed position or the open position to the other position by having a magnetic flux generated by the coil when an electric current flows through the coil. The regeneration unit includes a switch and a load. The regeneration unit is connected to the coil. The load is connected to the switch and consumes power when an electric current flows through the load. The control unit controls ON/OFF states of the switch. A regenerative current coming from the coil flows through the regeneration unit when the coil makes a transition from an energized state where the coil is supplied with an electric current from a power supply to a non-energized state where the coil is supplied with no electric current from the power supply. The control unit causes the regenerative current to flow through the load by controlling the switch when the coil makes the transition from the energized state to the non-energized state.

A control method according to another aspect of the present disclosure is method for controlling an electromagnetic relay. The electromagnetic relay includes: a fixed contact; a moving contact; an electromagnet device; and a regeneration unit. The moving contact is movable from a closed position where the moving contact is in contact with the fixed contact to an open position where the moving contact is out of contact with the fixed contact, and vice versa. The electromagnet device includes a coil. The electromagnet device moves the moving contact from one of the closed position or the open position to the other position by having a magnetic flux generated by the coil when an electric current flows through the coil. The regeneration unit includes a switch and a load. The regeneration unit is connected to the coil. The load is connected to the switch and consumes power when an electric current flows through the load. A regenerative current coming from the coil flows through the regeneration unit when the coil makes a transition from an energized state where the coil is supplied with an electric current from a power supply to a non-energized state where the coil is supplied with no electric current from the power supply. The control method includes causing the regenerative current to flow through the load by controlling the switch when the coil makes the transition from the energized state to the non-energized state.

DESCRIPTION OF EMBODIMENTS

Figure 1:
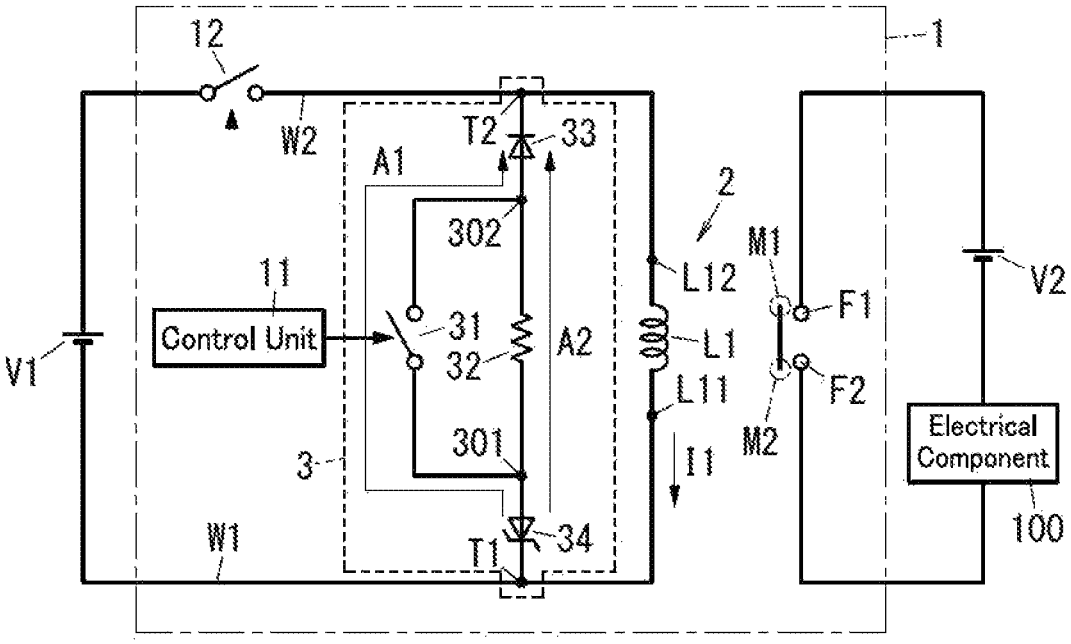
FIG. 1 is a circuit diagram of an electromagnetic relay according to a first embodiment.

Next, an electromagnetic relay according to an exemplary embodiment will be described with reference to the accompanying drawings Note that embodiments to be described below are only exemplary ones of various embodiments of the present disclosure and should not be construed as limiting. Rather, those exemplary embodiments may be readily modified in various manners depending on a design choice or any other factor without departing from the scope of the present disclosure.

First Embodiment

An electromagnetic relay 1 according to a first embodiment may be provided as a piece of onboard equipment for automobiles, for example. Next, a circuit configuration for the electromagnetic relay 1 will be described with reference to FIG. 1.

Circuit Configuration for Electromagnetic Relay

The electromagnetic relay 1 includes: an electromagnet device 2 (see FIG. 2); two fixed contacts F1, F2; two moving contacts M1, M2; a regeneration unit 3; and a control unit 11. The electromagnetic relay 1 further includes a power switch 12.

Each of the two fixed contacts F1, F2 and the two moving contacts M1, M2 has electrical conductivity. The moving contact M1 is electrically connected to the moving contact M2. Between the two fixed contacts F1, F2, a power supply V2 and an electrical component 100 that is connected to the power supply V2 in series may be electrically connected. The power supply V2 may be a battery for automobiles, for example. The electromagnet device 2 includes a coil L1. The coil L1 is supplied with an electric current from a power supply V1. The power supply V1 may be a power supply including a voltage step-down circuit for stepping down the voltage of the power supply V2, for example. The power switch 12 is provided on a line W2 for supplying an electric current from the power supply V1 (DC power supply) to the coil L1. The coil L1 is electrically connected to the power supply V1 via the power switch 12. The electrical component 100 does not have to be connected to the power supply V2 but any arbitrary load may be connected thereto instead.

When an electric current flows through the coil L1, the coil L1 generates a magnetic flux, thus moving and bringing the moving contact M1 into contact with the fixed contact F1 and also moving and bringing the moving contact M2 into contact with the fixed contact F2. This allows the two fixed contacts F1, F2 to be electrically connected together, thus supplying an electric current from the power supply V2 to the electrical component 100. In this electromagnetic relay 1, the state of the coil L1 alternately switches from an energized state in which the coil L1 is supplied with an electric current from the power supply V1 to a non-energized state in which the coil L1 is supplied with no electric current from the power supply V1, and vice versa. This causes the state of the electrical component 100 to alternately switch from a state where the electrical component 100 is supplied with an electric current from the power supply V2 to a state where the electrical component 100 is supplied with no electric current from the power supply V2, and vice versa.

A regenerative current I1 generated by the coil L1 flows through the regeneration unit 3. The regeneration unit 3 includes a switch 31 and a load 32. The switch 31 may be implemented as a semiconductor switch such as a MOSFET (metal-oxide semiconductor field-effect transistor), for example. The load 32 may be implemented as a resistor, for example. The switch 31 is connected to the load 32 in parallel.

The regeneration unit 3 further includes a diode 33 and a voltage regulator 34. The voltage regulator 34 may be a Zener diode, for example. However, this is only an example of the present disclosure and should not be construed as limiting. The voltage regulator 34 does not have to be a Zener diode but may also be varistor, for example. The diode 33 is connected in series to a parallel circuit of the switch 31 and the load 32. The voltage regulator 34 is connected in series to the parallel circuit of the switch 31 and the load 32 and to the diode 33. More specifically, the parallel circuit of the switch 31 and the load 32 is electrically connected between the diode 33 and the voltage regulator 34.

The regeneration unit 3 is connected to the coil L1 in parallel. More specifically, a first terminal T1 of the regeneration unit 3 is electrically connected to a first terminal L11 (low-potential terminal) of the coil L1. The first terminal T1 is a terminal, located adjacent to the voltage regulator 34, of the series circuit of the diode 33, the load 32, and the voltage regulator 34. A second terminal T2 of the regeneration unit 3 is electrically connected to a second terminal L12 (high-potential terminal) of the coil L1. The second terminal T2 is a terminal, located adjacent to the diode 33, of the series circuit of the diode 33, the load 32, and the voltage regulator 34.

The anode of the voltage regulator 34 is electrically connected to a first terminal 301 of the parallel circuit of the switch 31 and the load 32. The anode of the voltage regulator 34 is electrically connected to the second terminal T2 of the regeneration unit 3 via the parallel circuit of the switch 31 and the load 32 and the diode 33. The cathode of the voltage regulator 34 is electrically connected to the first terminal T1 of the regeneration unit 3.

The anode of the diode 33 is electrically connected to a second terminal 302 of the parallel circuit of the switch 31 and the load 32. The anode of the diode 33 is electrically connected to the first terminal T1 of the regeneration unit 3 via the parallel circuit of the switch 31 and the load 32 and the voltage regulator 34. The cathode of the diode 33 is electrically connected to the second terminal T2 of the regeneration unit 3.

More specifically, the anode of the diode 33 is connected to the low-potential line W1 between the power supply V1 and the coil L1 via the parallel circuit of the switch 31 and the load 32, the voltage regulator 34, and the first terminal T1. On the other hand, the cathode of the diode 33 is connected to the high-potential line W2 between the power supply V1 and the coil L1 via the second terminal T2.

The diode 33 reduces the amount of an electric current flowing from the power supply V1 into the parallel circuit of the switch 31 and the load 32.

When transition is made from the state where an electric current is supplied from the power supply V1 to the coil L1 to the state where no electric current is supplied from the power supply V1 to the coil L1, the coil L1 generates a regenerative current I1 by self-induction. Also, when the counterelectromotive voltage (surge voltage that is a type of self-induced voltage) of the coil L1 is greater than a predetermined voltage, the voltage between both terminals of the voltage regulator 34 becomes greater than the breakdown voltage of the voltage regulator 34 (implemented as a Zener diode), and an electric current flows from one terminal (i.e., the cathode), connected to the first terminal T1, of the voltage regulator 34 to the other terminal (i.e., the anode) thereof connected to the second terminal T2. Therefore, when the counterelectromotive voltage of the coil L1 is greater than the predetermined voltage, the regenerative current I1 generated by the coil L1 flows through the voltage regulator 34 (regeneration unit 3).

The power switch 12 is electrically connected between the parallel circuit of the regeneration unit 3 and the coil L1 and the power supply V1. The power switch 12 may be implemented as a semiconductor switching element such as a MOSFET (metal-oxide semiconductor field-effect transistor), for example.

The control unit 11 controls the ON/OFF states of the switch 31. In addition, the control unit 11 (power supply switch control unit) also controls the ON/OFF states of the power switch 12. More specifically, the control unit 11 controls the ON/OFF states of the switch 31 by regulating the gate voltage of the switch 31. Also, the control unit 11 controls the ON/OFF states of the power switch 12 by regulating the gate voltage of the power switch 12. The control unit 11 may be implemented as a computer including a processor (microcomputer).

As described above, in the electromagnetic relay 1, the state of the coil L1 alternately switches from the energized state where the coil L1 is supplied with an electric current from the power supply V1 to the non-energized state where the coil L1 is supplied with no electric current from the power supply V1, and vice versa. More specifically, the energized state is a state where the control unit 11 turns the power switch 12 ON. The non-energized state is a state where the control unit 11 turns the power switch 12 OFF.

Structure of Electromagnetic Relay

Figure 2:
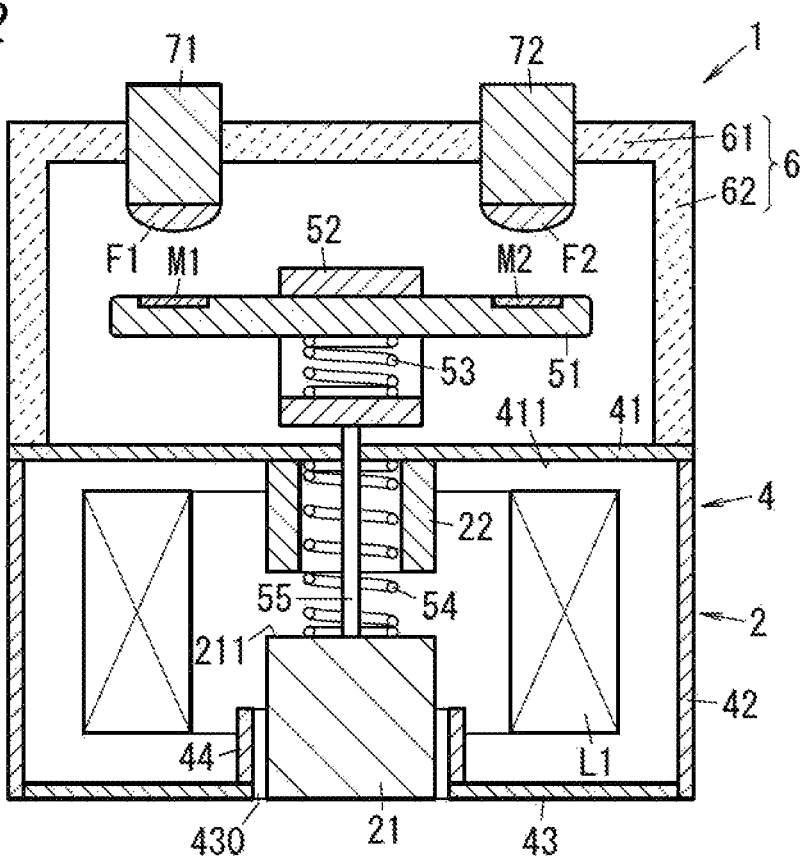
FIG. 2 is a cross-sectional view of the electromagnetic relay in a state where no electric current is flowing through its coil.

Next, the structure of the electromagnetic relay 1 will be described with reference to FIGS. 2 and 3.

The electromagnet device 2 of the electromagnetic relay 1 includes: the coil L1; a mover 21; a stator 22; and a yoke 4. The electromagnetic relay 1 further includes: a moving contactor 51; a holder 52; a contact pressure spring 53; a return spring 54; a shaft 55; a case 6; a first contact carrier 71; and a second contact carrier 72. The electromagnetic relay 1 may further include a coil bobbin around which the coil L1 is wound.

In the following description, the direction in which the mover 21 and the stator 22 are arranged in FIGS. 2 and 3 will be hereinafter defined as an "upward/downward direction," the stator 22 is defined to be on an upper side when viewed from the mover 21, and the mover 21 is defined to be on a lower side when viewed from the stator 22. In addition, the direction in which the first contact carrier 71 and the second contact carrier 72 are arranged side by side is defined herein to be a rightward/leftward direction, the first contact carrier 71 is defined to be on the left when viewed from the second contact carrier 72, and the second contact carrier 72 is defined to be on the right when viewed from the first contact carrier 71.

The yoke 4 is made of a magnetic material such as iron. The yoke 4 includes a first wall portion 41, a second wall portion 42, a third wall portion 43, and a fourth wall portion 44. The first wall portion 41 and the third wall portion 43 are each formed in the shape of a rectangular plate. The first wall portion 41 and the third wall portion 43 each have a thickness in the upward/downward direction. The second wall portion 42 and the fourth wall portion 44 are each formed in a cylindrical shape. The respective axes of the second wall portion 42 and the fourth wall portion 44 are both aligned with the upward/downward direction. The second wall portion 42 is formed in the shape of a rectangular cylinder when viewed in the axial direction. The second wall portion 42 couples the four sides of the first wall portion 41 to the corresponding four sides of the third wall portion 43. That is to say, the second wall portion 42 is formed to extend from the outer peripheral edges of the first wall portion 41 through the outer peripheral edges of the third wall portion 43. The third wall portion 43 has a circular opening 430. The fourth wall portion 44 is a member provided separately from the first wall portion 41, the second wall portion 42, and the third wall portion 43. The fourth wall portion 44 protrudes upward from the circumferential edge of the opening 430. The fourth wall portion 44 is formed in shape of a circular cylinder.

Note that the second wall portion 42 does not have to be formed in the cylindrical shape. Alternatively, the second wall portion 42 may also be formed as a pair of rectangular plates connecting the first wall portion 41 and the third wall portion 43 together and respectively arranged on the right and the left of the coil L1.

The stator 22 is made of a magnetic material such as iron. The stator 22 protrudes downward from a lower surface 411 of the first wall portion 41. The stator 22 is formed in the shape of a circular cylinder.

The mover 21 is also made of a magnetic material such as iron. When no electric current is flowing through the coil L1, the mover 21 is located in the opening 430 of the third wall portion 43 and inside the fourth wall portion 44. The mover 21 faces the stator 22 in the upward/downward direction. The mover 21 is formed in the shape of a circular column.

The return spring 54 may be implemented as a compression coil spring, for example. At least part of the return spring 54 is arranged inside the stator 22. A first end of the return spring 54 in the direction in which the mover 21 and the stator 22 are arranged (i.e., in the upward/downward direction) is in contact with a surface, facing the stator 22 (i.e., an upper surface 211), of the mover 21. A second end of the return spring 54 is in contact with the lower surface 411 of the first wall portion 41 of the yoke 4.

The shaft 55 protrudes upward from the upper surface 211 of the mover 21. The shaft 55 runs through the first wall portion 41 of the yoke 4. The shaft 55 is formed in the shape of a circular column. The return spring 54 is arranged to surround the shaft 55. The shaft 55 may be made of a non-magnetic material, for example.

The holder 52 is connected to the shaft 55. The holder 52 is formed in the shape of a rectangular cylinder. The axis of the holder 52 is aligned with the rightward/leftward direction. Inside the holder 52, arranged are part of the moving contactor 51 and the contact pressure spring 53. The contact pressure spring 53 may be implemented as a compression coil spring, for example. Upward force is applied from the contact pressure spring 53 to the moving contactor 51.

The moving contactor 51 is a plate member. The moving contactor 51 has electrical conductivity. The longitudinal axis of the moving contactor 51 is aligned with the rightward/leftward direction. A moving contact M1 is fixed on the top of a first longitudinal end (left end) of the moving contactor 51 and a moving contact M2 is fixed on the top of a second longitudinal end (right end) of the moving contactor 51. This allows the moving contactor 51 to be electrically connected to the two moving contacts M1, M2. In addition, the two moving contacts M1, M2 are also electrically connected together via the moving contactor 51.

The case 6 is formed in a box shape. The case 6 includes: a base portion 61 having thickness in the upward/downward direction; and a cylindrical portion 62 protruding downward from the base portion 61. The tip of the cylindrical portion 62 is connected to the first wall portion 41 of the yoke 4. The case 6 and the first wall portion 41 together form a space in which the two fixed contacts F1, F2 and the two moving contacts M1, M2 are housed.

The two fixed contacts F1, F2 are electrically connected to the power supply V2 (see FIG. 1) and the electrical component 100 (see FIG. 1) via the first contact carrier 71 and the second contact carrier 72, respectively. The first contact carrier 71 and the second contact carrier 72 are fixed onto the base portion 61 of the case 6. The first contact carrier 71 and the second contact carrier 72 run through the base portion 61. The first contact carrier 71 and the second contact carrier 72 have electrical conductivity. The fixed contact F1 is electrically connected to the first contact carrier 71. The fixed contact F2 is electrically connected to the second contact carrier 72. The fixed contact F1 faces the moving contact M1 in the upward/downward direction. The fixed contact F2 faces the moving contact M2 in the upward/downward direction.

When no electric current is flowing through the coil L1, the two moving contacts M1, M2 are out of contact with the two fixed contacts F1, F2, respectively. The position of the two moving contacts M1, M2 in such a situation is defined herein to be an open position. When the two moving contacts M1, M2 are located at the open position, the path between the first contact carrier 71 and the second contact carrier 72 is electrically open.

The coil L1 is arranged to surround the mover 21 and the stator 22. When the power switch 12 (see FIG. 1) turns ON, an electric current flows through the coil L1, thus causing the coil L1 to generate a magnetic flux. The magnetic flux generated by the coil L1 passes through the yoke 4, the mover 21, and the stator 22. The magnetic flux generated by the coil L1 produces attractive force between the mover 21 and the stator 22. This attractive force causes the mover 21 to move toward the stator 22. That is to say, in this case, the mover 21 moves upward. More specifically, in this case, the mover 21 moves upward while compressing the return spring 54. Furthermore, in this case, the mover 21 moves while being guided by the fourth wall portion 44 of the yoke 4.

The two moving contacts M1 M2 are connected to the mover 21 via the shaft 55, the holder 52, and the moving contactor 51. This allows the two moving contacts M1, M2 to move along with the mover 21.

Figure 3:
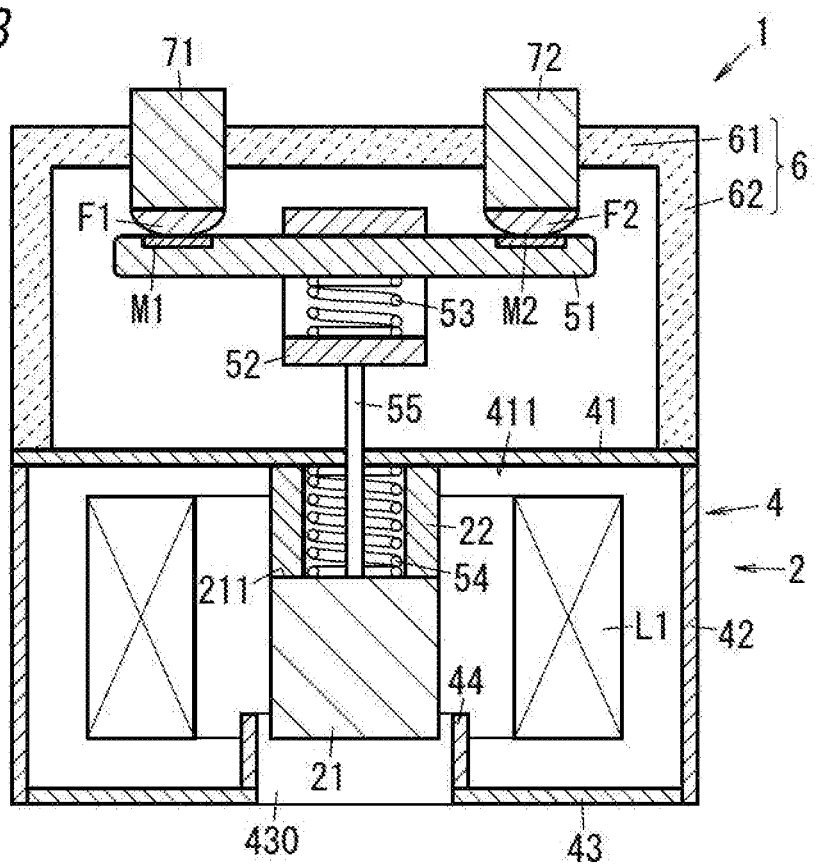
FIG. 3 is a cross-sectional view of the electromagnetic relay in a state where an electric current is flowing through its coil.

When an electric current flows through the coil L1 while the two moving contacts M1, M2 are located at the open position, the two moving contacts M1, M2 move upward along with the mover 21, thus bringing the moving contacts M1, M2 into contact with the fixed contacts F1, F2, respectively, as shown in FIG. 3. Thus, the moving contacts M1, M2 are electrically connected to the fixed contacts F1, F2, respectively. Consequently, the first contact carrier 71 and the second contact carrier 72 are also electrically connected together. The position of the two moving contacts M1, M2 in a situation where the moving contacts M1, M2 are in contact with the fixed contacts F1, F2, respectively, is defined herein to be a closed position. When the two moving contacts M1, M2 are located at the closed position, the upward force applied from the contact pressure spring 53 to the moving contactor 51 produces contact pressure between the moving contact M1 and the fixed contact F1 and between the moving contact M2 and the fixed contact F2. When the two moving contacts M1, M2 are located at the closed position, the mover 21 is in contact with the stator 22.

As the amount of the electric current flowing through the coil L1 decreases to reduce the magnetic flux generated by the coil L1, the attractive force between the mover 21 and the stator 22 decreases as well. When the attractive force becomes less than the elastic force of the return spring 54, the elastic force of the return spring 54 causes the mover 21 to move downward. Then, the two moving contacts M1, M2 also move downward along with the mover 21. This causes the two moving contacts M1, M2 to move from the closed position to the open position.

Also, the elastic force of the return spring 54 is applied in such a direction as to move the mover 21 downward. This reduces, when vibration or impact is applied to the electromagnetic relay 1 while the two moving contacts M1, M2 are located at the open position to keep the mover 21 out of contact with the stator 22, the chances of the mover 21 moving toward the stator 22.

Exemplary Operation of Electromagnetic Relay

Next, an exemplary operation of the electromagnetic relay 1 will be described in further detail with reference to FIGS. 1 and 4.

The control unit 11 controls the ON/OFF states of the power switch 12 and the switch 31. When the control unit 11 turns the power switch 12 ON to make the coil L1 energized, the two moving contacts M1, M2 move from the open position to the closed position and an electric current is supplied from the power supply V2 to the electrical component 100. When an amount of time passes since the control unit 11 has turned the power switch 12 OFF to make the coil L1 non-energized, the two moving contacts M1, M2 move to the open position and no electric current is supplied from the power supply V2 to the electrical component 100 any longer.

Figure 4:
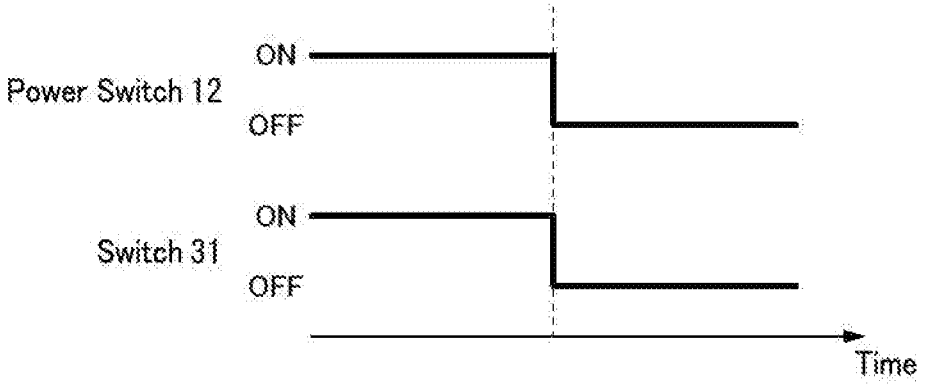
FIG. 4 is a timing diagram characteristic of the electromagnetic relay.

While keeping the coil L1 energized by turning the power switch 12 ON, the control unit 11 also keeps the switch 31 ON (see FIG. 4). On the other hand, while keeping the coil L1 non-energized by turning the power switch 12 OFF, the control unit 11 also keeps the switch 31 OFF (see FIG. 4).

If any vibration or impact is applied to the electromagnetic relay 1 while the control unit 11 is keeping the coil L1 energized by turning the power switch 12 ON, then the supply of an electric current from the power supply V1 to the coil L1 could be temporarily cut off (i.e., instantaneous cutoff could occur). In such a situation, the coil L1 generates a regenerative current I1 by self-induction. Also, at this time, the switch 31 is still kept ON. Furthermore, in this situation, the counterelectromotive voltage of the coil L1 is supposed to be greater than a predetermined voltage. That is to say, at this time, an electric current flows from one terminal (cathode), connected to the first terminal T1, of the voltage regulator 34 toward the other terminal (anode) thereof connected to the second terminal T2. Thus, the regenerative current I1 generated by the coil L1 passes through a path A1 (that runs through the voltage regulator 34, the switch 31, and the diode 33 in this order) to return to the coil L1.

As can be seen, if the supply of an electric current from the power supply V1 to the coil L1 is temporality cut off while the coil L1 is energized, the regenerative current I1 passes through the switch 31 to return to the coil L1. Since the regenerative current I1 keeps causing the coil L1 to generate a magnetic flux for a while, the two moving contacts M1, M2 stay at the closed position and an electric current continues to be supplied from the power supply V2 to the electrical component 100. At this time, the amount of the regenerative current I1 flowing through the load 32 is smaller than that of the regenerative current I1 flowing through the switch 31. Thus, compared to a situation where the switch 31 is OFF to cause the regenerative current I1 to flow through the load 32, not through the switch 31, the power consumption of the load 32 is cut down, thus allowing the electric current to be supplied continuously for a longer time from the power supply V2 to the electrical component 100.

The counterelectromotive voltage of the coil L1 decreases with the passage of time since the generation of the counterelectromotive voltage. The smaller the counterelectromotive voltage of the coil L1 is, the smaller the voltage between both terminals of the voltage regulator 34 is. Thus, the lower the breakdown voltage of the voltage regulator 34 (Zener diode) is, the longer the amount of time for which the regenerative current I1 flows through the coil L1 and the regeneration unit 3 is. Changing the voltage regulator 34 into another Zener diode with a different breakdown voltage allows the amount of time for which the regenerative current I1 flows through the coil L1 and the regeneration unit 3 to be adjusted. This makes, when the supply of an electric current from the power supply V1 to the coil L1 is temporarily cut off, the amount of time for which an electric current is supplied continuously from the power supply V2 to the electrical component 100 adjustable. Optionally, the voltage regulator 34 may be omitted from the regeneration unit 3. The amount of time for which an electric current is supplied continuously from the power supply V2 to the electrical component 100 when the supply of an electric current from the power supply V1 to the coil L1 is temporarily cut off is adjustable depending on whether the voltage regulator 34 is provided or not.

When the control unit 11 turns the power switch 12 from ON to OFF, the coil L1 makes a transition from the energized state to the non-energized state. Then, the coil L1 generates the regenerative current I1 by self-induction. The control unit 11 turns the switch 31 OFF while keeping the power switch 12 OFF. Thus, the switch 31 is OFF at this time. Also, at this time, the counterelectromotive voltage of the coil L1 is supposed to be greater than a predetermined voltage. That is to say, in this case, an electric current flows from one terminal (cathode), connected to the first terminal T1, of the voltage regulator 34 toward the other terminal (anode) thereof connected to the second terminal T2. Thus, the regenerative current I1 generated by the coil L1 flows through a path A2 that passes through the voltage regulator 34, the load 32, and the diode 33 in this order to return to the coil L1.

In short, when the coil L1 makes a transition from the energized state to the non-energized state, the control unit 11 controls (i.e., turns OFF) the switch 31 to cause the regenerative current I1 to flow through the load 32. As the regenerative current I1 flows through the load 32, the load 32 consumes power. This causes the regenerative current I1, the magnetic flux generated by the coil L1 due to the regenerative current I1, and the attractive force produced by the magnetic flux between the mover 21 (see FIG. 2) and the stator 22 (see FIG. 2) to decrease more quickly compared to a situation where no regenerative current I1 flows through the load 32. This allows, when the control unit 11 turns the power switch 12 from ON to OFF, the two moving contacts M1, M2 to move more quickly from the closed position to the open position. Consequently, this allows the arc generated when the two moving contacts M1, M2 go out of contact with the two fixed contacts F1, F2, respectively, to be extinguished more quickly. In addition, this also allows a transition to be made more quickly from the state where an electric current is supplied from the power supply V2 to the electrical component 100 to the state where no electric current is supplied from the power supply V2 to the electrical component 100.

Figure 5:
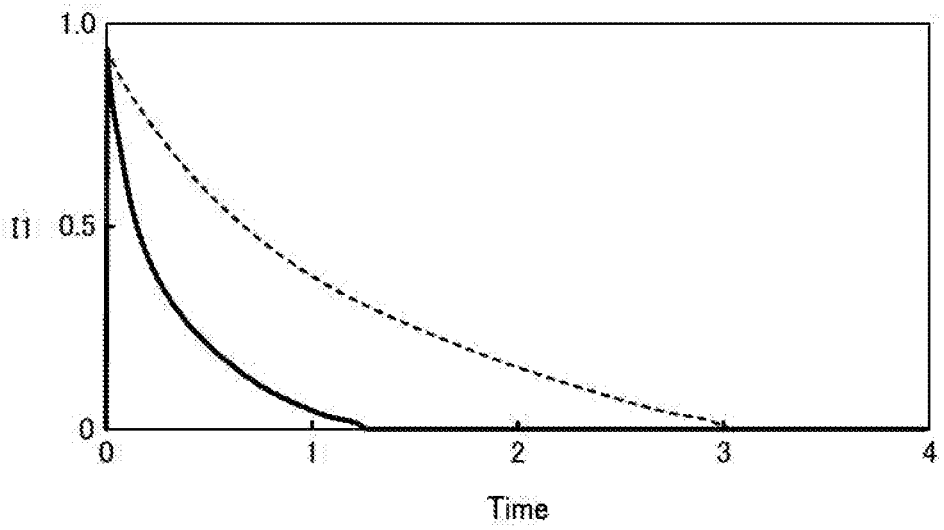
FIG. 5 is a graph showing how the amount of a regenerative current flowing through the coil of the electromagnetic relay changes with time.
Figure 6:
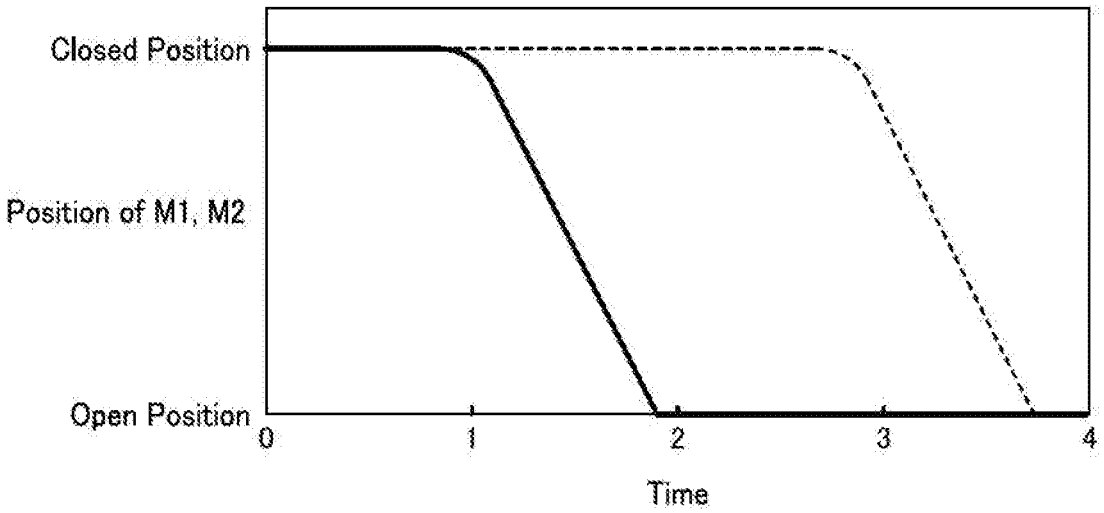
FIG. 6 is a graph showing how the position of the two moving contacts changes with time in the electromagnetic relay.

FIG. 5 shows how the amount of the regenerative current I1 flowing through the coil L1 changes with the amount of time that has passed since the control unit 11 turned the power switch 12 from ON to OFF. In FIG. 5, the solid curve indicates the amount of the regenerative current I1 flowing in a situation where the switch 31 is OFF, while the dotted curve indicates the amount of the regenerative current I1 flowing in a situation where the switch 31 is ON. FIG. 6 shows how the position of the two moving contacts M1, M2 changes with the amount of time that has passed since the control unit 11 turned the power switch 12 from ON to OFF. In FIG. 6, the solid curve indicates the position of the two moving contacts M1, M2 in a situation where the switch 31 is OFF, while the dotted curve indicates the position of the two moving contacts M1, M2 in a situation where the switch 31 is ON. Note that the ordinate and abscissa shown in FIG. 5 and the abscissa shown in FIG. 6 indicate numerical values that are normalized such that one scale represents certain magnitude.

As shown in FIG. 5, in a situation where the switch 31 is OFF, the magnitude of decrease in the regenerative current I1 per unit time is more significant, and the regenerative current I1 goes zero in a shorter time, than in a situation where the switch 31 is ON. As a result, as shown in FIG. 6, in a situation where the switch 31 is ON, it takes a longer time for the two moving contacts M1, M2 to start moving from the closed position toward the open position and to reach the open position, than in a situation where the switch 31 is OFF.

When turning the power switch 12 ON to supply an electric current to the electrical component 100, the control unit 11 turns the switch 31 ON. This allows, when the supply of an electric current from the power supply V1 to the coil L1 is temporarily cut off, the two moving contacts M1, M2 to stay at the closed position for a longer time than in a situation where the switch 31 is OFF, thus allowing an electric current to be supplied continuously from the power supply V2 to the electrical component 100 for a longer time. On the other hand, to make a transition from a state where the electrical component 100 is supplied with an electric current to a state where the electrical component 100 is supplied with no electric current, the control unit 11 turns the switch 31 OFF. This allows, compared to a situation where the switch 31 is ON, the two moving contacts M1, M2 to move to the open position more quickly, thus enabling the supply of the electric current from the power supply V2 to the electrical component 100 to be cut off more quickly and also enabling the arc generated on the two moving contacts M1, M2 to be extinguished more quickly.

Variations of First Embodiment

Next, variations of the first embodiment will be enumerated one after another. Optionally, the variations to be described below may be adopted in combination as appropriate.

In the first embodiment described above, the control unit 11 has the capability of controlling the ON/OFF states of the switch 31 and the capability of controlling the ON/OFF states of the power switch 12. Alternatively, a constituent element having the capability of controlling the ON/OFF states of the switch 31 and a constituent element having the capability of controlling the ON/OFF states of the power switch 12 may be provided independently of each other.

Figure 7:
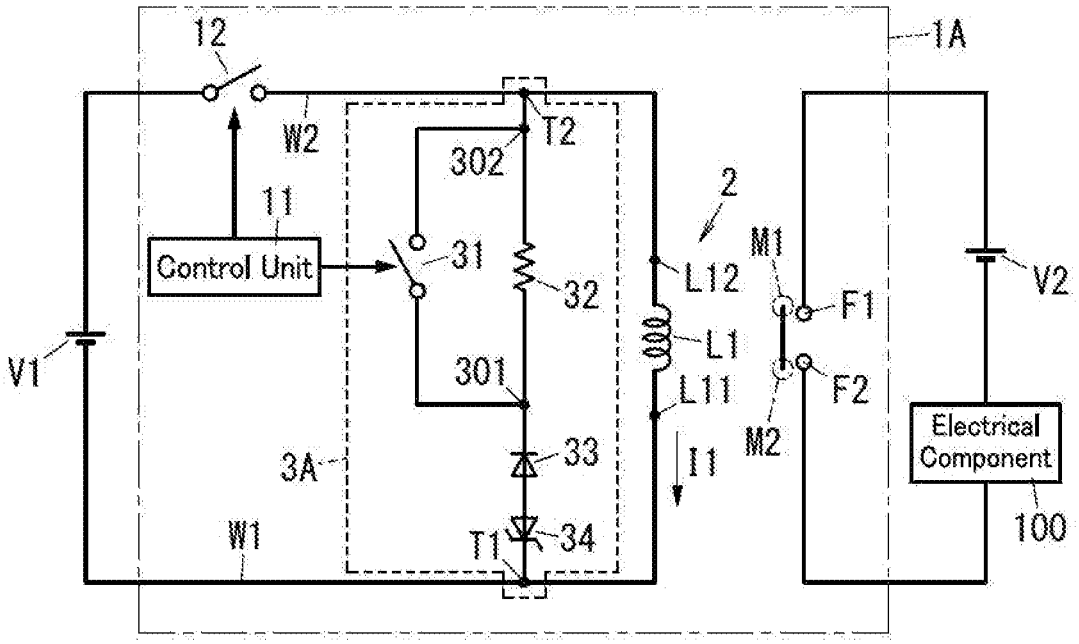
FIG. 7 is a circuit diagram of an electromagnetic relay according to a variation of the first embodiment.
Figure 8:
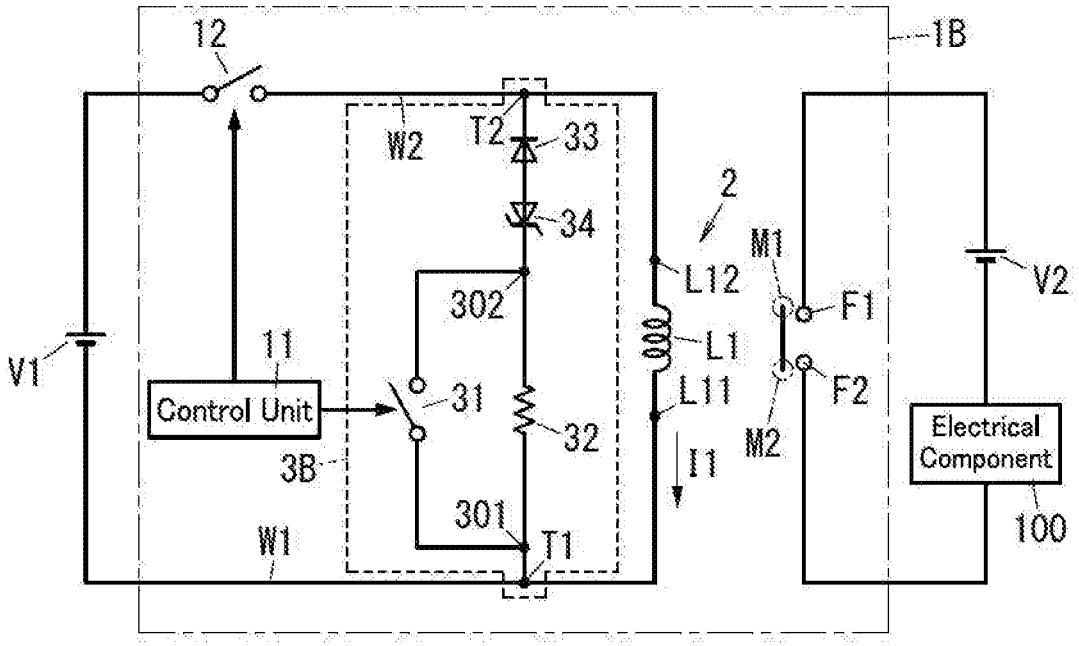
FIG. 8 is a circuit diagram of an electromagnetic relay according to another variation of the first embodiment.

Also, the electric current supplied from the power supply V1 to the coil L1 in a situation where the power switch 12 is ON suitably does not flow through the switch 31. This allows the power loss caused by the switch 31 to be cut down. For example, as shown in FIG. 1, the parallel circuit of the switch 31 and the load 32 is suitably electrically connected between the anode of the diode 33 and the anode of the voltage regulator 34. Alternatively, as shown in FIG. 7, the diode 33 may also be electrically connected between the first terminal 301 of the parallel circuit of the switch 31 and the load 32 and the voltage regulator 34. In the electromagnetic relay 1A shown in FIG. 7, a regeneration unit 3A is connected to the coil L1 in parallel. Alternatively, as shown in FIG. 8, the voltage regulator 34 may also be connected between a second terminal 302 of a series circuit of the switch 31 and the load 32 and the diode 33. In the electromagnetic relay 1B shown in FIG. 8, a regeneration unit 3B is connected to the coil L1 in parallel.

In the first embodiment described above, the two moving contacts M1, M2 and the two fixed contacts F1, F2 form a-contacts. However, this is only an example of the present disclosure and should not be construed as limiting. Alternatively, the two moving contacts M1, M2 and the two fixed contacts F1, F2 may also form b-contacts or c-contacts.

Furthermore, the electromagnetic relay 1 according to the first embodiment is implemented as a plunger type relay in which the linear movement (displacement) of the mover 21 brings the two moving contacts M1, M2 into, or out of, contact with the two fixed contacts F1, F2, respectively. However, the electromagnetic relay 1 does not have to be implemented as a plunger type relay. Alternatively, the electromagnetic relay 1 may also be implemented as, for example, a hinged relay in which rotation of the mover around a fulcrum causes the moving contacts to move to bring the moving contacts into, or out of, contact with the fixed contacts.

Furthermore, the number of the fixed contacts provided does not have to be two but may also be one, or even three or more. Likewise, the number of the moving contacts provided does not have to be two, either, but may also be one, or even three or more.

Furthermore, the electromagnet device 2, the control unit 11, the power switch 12, and the regeneration unit 3 may be aggregated together in a single housing or distributed in multiple housings. Some or all of the control unit 11, the power switch 12, and the regeneration unit 3 may be arranged in the cavity inside the yoke 4, housed in the case 6, or housed in a housing provided separately from the yoke 4 and the case 6.

Resume of First Embodiment

As can be seen from the foregoing description, an electromagnetic relay 1 (or 1A, 1B) according to a first aspect includes: two fixed contacts F1, F2; two moving contacts M1, M2; an electromagnet device 2; a regeneration unit 3 (or 3A, 3B); and a control unit 11. The two moving contacts M1, M2 are movable from a closed position where the two moving contacts M1, M2 are in contact with the two fixed contacts F1, F2, respectively, to an open position where the two moving contacts M1, M2 are out of contact with the two fixed contacts F1, F2, respectively, and vice versa. The electromagnet device 2 includes a coil L1. The electromagnet device 2 moves the two moving contacts M1, M2 from one of the closed position or the open position to the other position by having a magnetic flux generated by the coil L1 when an electric current flows through the coil L1. The regeneration unit 3 (or 3A, 3B) includes a switch 31 and a load 32. The regeneration unit 3 (or 3A, 3B) is connected to the coil L1. The load 32 is connected to the switch 31 and consumes power when an electric current flows through the load 32. The control unit 11 controls ON/OFF states of the switch 31. A regenerative current I1 coming from the coil L1 flows through the regeneration unit 3 (or 3A, 3B) when the coil L1 makes a transition from an energized state where the coil L1 is supplied with an electric current from a power supply V1 to a non-energized state where the coil L1 is supplied with no electric current from the power supply V1. The control unit 11 causes the regenerative current I1 to flow through the load 32 by controlling the switch 31 when the coil L1 makes the transition from the energized state to the non-energized state.

According to this configuration, when the coil L1 makes the transition from the energized state to the non-energized state, the load 32 consumes the regenerative current I1. This allows the regenerative current I1 generated by the coil L1 to be reduced more quickly than when the electromagnetic relay 1 (or 1A, 1B) has no load 32.

In an electromagnetic relay 1 (or 1A, 1B) according to a second aspect, which may be implemented in conjunction with the first aspect, the switch 31 is connected to the load 32 in parallel. The regeneration unit 3 (or 3A, 3B) further includes a diode 33. The diode 33 is connected in series to a parallel circuit of the switch 31 and the load 32. A cathode of the diode 33 is to be connected to a high-potential line W2 between the power supply V1 and the coil L1. The regeneration unit 3 (or 3A, 3B) is connected to the coil L1 in parallel.

According to this configuration, the regeneration unit 3 (or 3A, 3B) is connected to the coil L1 in parallel. This reduces the chances of the regenerative current I1 flowing through a circuit (such as the power supply V1) other than the regeneration unit 3 (or 3A, 3B).

In an electromagnetic relay 1 (or 1A, 1B) according to a third aspect, which may be implemented in conjunction with the second aspect, the regeneration unit 3 (or 3A, 3B) further includes a voltage regulator 34. The voltage regulator 34 is connected in series to the parallel circuit of the switch 31 and the load 32 and to the diode 33. The regenerative current I1 flows through the voltage regulator 34 when a counterelectromotive voltage of the coil L1 is greater than a predetermined voltage.

This configuration allows, when the coil L1 makes the transition from the energized state to the non-energized state to generate a counterelectromotive voltage greater than a predetermined voltage, a circuit (such as the power supply V1) other than the regeneration unit 3 (or 3A, 3B) to be protected from the counterelectromotive voltage.

In an electromagnetic relay 1 (or 1A, 1B) according to a fourth aspect, which may be implemented in conjunction with the third aspect, the voltage regulator 34 is a Zener diode.

This configuration allows the voltage regulator 34 to be implemented as a Zener diode.

In an electromagnetic relay 1 (or 1A, 1B) according to a fifth aspect, which may be implemented in conjunction with any one of the first to fourth aspects, the switch 31 is connected to the load 32 in parallel. The control unit 11 turns the switch 31 ON when the coil L1 is in the energized state and turns the switch 31 OFF when the coil L1 is in the non-energized state.

According to this configuration, when the coil L1 makes the transition from the energized state to the non-energized state, the switch 31 turns OFF to cause the regenerative current I1 to flow through the load 32 and be consumed. On the other hand, when the coil L1 is in the energized state, the switch 31 is ON. Thus, even if supply of an electric current from the power supply V1 to the coil L1 is temporarily cut off, the regenerative current I1 still circulates between the regeneration unit 3 (or 3A, 3B) and the coil L1, thus maintaining a state where an electric current flows through the coil L1.

In an electromagnetic relay 1 (or 1A, 1B) according to a sixth aspect, which may be implemented in conjunction with any one of the first to fifth aspects, the electromagnet device 2 further includes a mover 21, a yoke 4, and a stator 22. The mover 21 moves along with the two moving contacts M1, M2. The yoke 4 allows the magnetic flux generated by the coil L1 to pass therethrough. Attractive force is produced between the mover 21 and the stator 22 by the magnetic flux generated by the coil L1, thus causing the mover 21 to move.

This configuration causes the regenerative current I1 generated by the coil L1 to be consumed by the load 32 and reduced more quickly, thus allowing the attractive force produced between the mover 21 and the stator 22 to be reduced more quickly in the electromagnet device 2.

In an electromagnetic relay 1 (or 1A, 1B) according to a seventh aspect, which may be implemented in conjunction with any one of the first to sixth aspects, the load 32 includes a resistor.

According to this configuration, the load 32 is a resistor, which is easily implementable on a board provided for the electromagnetic relay 1 (or 1A, 1B). In addition, the power consumption of the load 32 is easily changeable either by replacing the load 32 with another resistor having a different resistance value or by using a variable resistor as the load 32. That is to say, the magnitude of decrease in the regenerative current I1 generated by the coil L1 is easily changeable.

Note that constituent elements according to every aspect but the first aspect are not essential constituent elements for the electromagnetic relay 1 (or 1A, 1B) but may be omitted as appropriate.

A control method according to an eighth aspect is method for controlling an electromagnetic relay 1 (or 1A, 1B). The electromagnetic relay 1 (or 1A, 1B) includes: two fixed contacts F1, F2; two moving contacts M1, M2; an electromagnet device 2; and a regeneration unit 3 (or 3A, 3B). The two moving contacts M1, M2 are movable from a closed position where the two moving contacts M1, M2 are in contact with the two fixed contacts F1, F2, respectively, to an open position where the two moving contacts M1, M2 are out of contact with the two fixed contacts F1, F2, respectively, and vice versa. The electromagnet device 2 includes a coil L1. The electromagnet device 2 moves the two moving contacts M1, M2 from one of the closed position or the open position to the other position by having a magnetic flux generated by the coil L1 when an electric current flows through the coil L1. The regeneration unit 3 (or 3A, 3B) includes a switch 31 and a load 32. The regeneration unit 3 (or 3A, 3B) is connected to the coil L1. The load 32 is connected to the switch 31 and consumes power when an electric current flows through the load 32. A regenerative current I1 coming from the coil L1 flows through the regeneration unit 3 (or 3A, 3B) when the coil L1 makes a transition from an energized state where the coil L1 is supplied with an electric current from a power supply V1 to a non-energized state where the coil L1 is supplied with no electric current from the power supply V1. The control method includes causing the regenerative current I1 to flow through the load 32 by controlling the switch 31 when the coil L1 makes a transition from the energized state to the non-energized state.

According to this configuration, when the coil L1 makes a transition from the energized state to the non-energized state, the load 32 consumes the regenerative current I1. This allows the regenerative current I1 generated by the coil L1 to be reduced more quickly than when the electromagnetic relay 1 (or 1A, 1B) has no load 32.

Note that these are only exemplary aspects of the present disclosure but various configurations of the electromagnetic relay 1 (or 1A, 1B) according to the first embodiment (including variations thereof) are also implementable as a control method.

Second Embodiment

Figure 9:
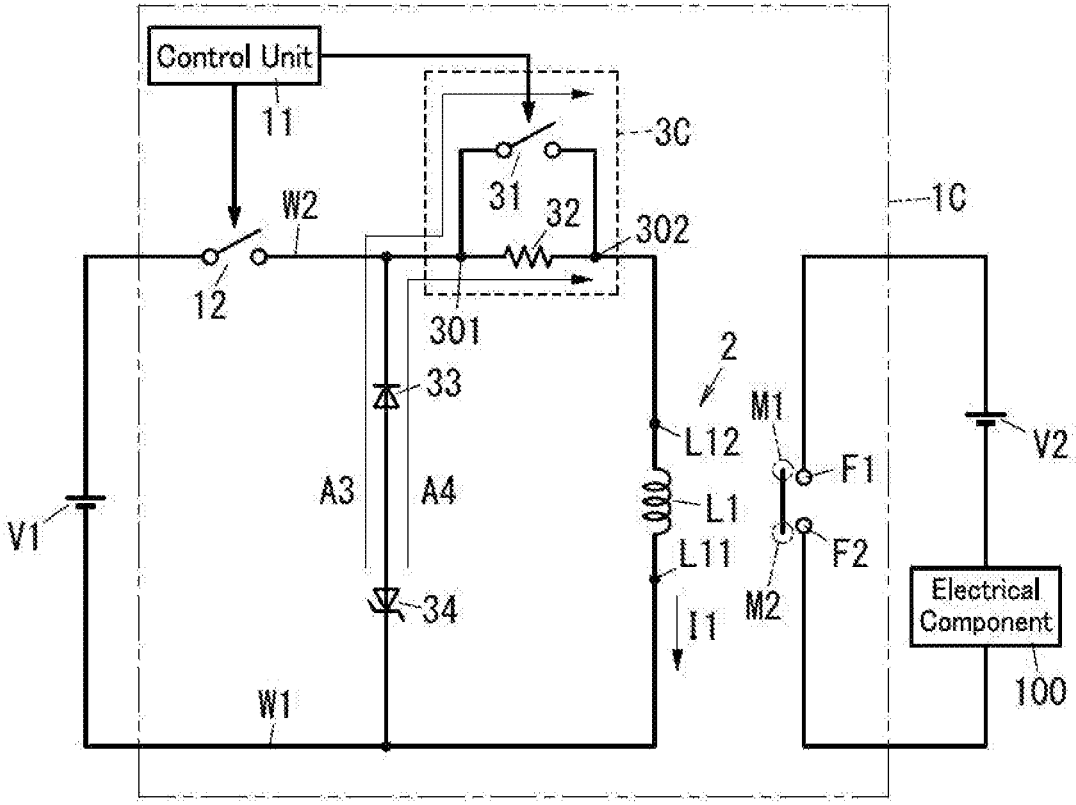
FIG. 9 is a circuit diagram of an electromagnetic relay according to a second embodiment.

Next, an electromagnetic relay 1C according to a second embodiment will be described with reference to FIG. 9. In the following description, any constituent element of this second embodiment, having the same function as a counterpart of the first embodiment described above, will be designated by the same reference numeral as that counterpart's, and description thereof will be omitted herein.

In the electromagnetic relay 1C, the regeneration unit 3C thereof includes a parallel circuit of the switch 31 and the load 32. The diode 33 and the voltage regulator 34 are provided as external devices outside of the regeneration unit 3C of the electromagnetic relay 1C. The regeneration unit 3C is connected to the coil L1 in series. A second terminal 302 of the parallel circuit of the switch 31 and the load 32 is electrically connected to a second terminal L12 (which is a high-potential terminal) of the coil L1. A first terminal 301 of the parallel circuit of the switch 31 and the load 32 is electrically connected to the power supply V1 via the power switch 12. The cathode of the diode 33 is electrically connected between the power switch 12 and the first terminal 301 of the parallel circuit of the switch 31 and the load 32. The anode of the diode 33 is electrically connected to the anode of the voltage regulator 34 (Zener diode). The cathode of the voltage regulator 34 is electrically connected between a first terminal L11 (which is a low-potential terminal) of the coil L1 and the power supply V1.

While keeping the coil L1 energized by turning the power switch 12 ON, the control unit 11 also keeps the switch 31 ON (see FIG. 4). On the other hand, while keeping the coil L1 non-energized by turning the power switch 12 OFF, the control unit 11 also keeps the switch 31 OFF (see FIG. 4).

According to this configuration, if the supply of an electric current from the power supply V1 to the coil L1 is temporality cut off while the control unit 11 keeps the coil L1 energized by turning the power switch 12 ON, the regenerative current I1 generated by the coil L1 flows along a path A3 to return to the coil L1. Along the path A3, the regenerative current I1 passes through the voltage regulator 34, the diode 33, and the switch 31 in this order. At this time, the amount of the regenerative current I1 flowing through the load 32 is smaller than that of the regenerative current I1 flowing through the switch 31. Thus, compared to a situation where the switch 31 is OFF to cause the regenerative current I1 to flow through the load 32, not through the switch 31, the power consumption of the load 32 is smaller, thus allowing the electric current to be supplied continuously for a longer time from the power supply V2 to the electrical component 100.

On the other hand, if the control unit 11 has switched the state of the coil L1 from the energized state into the non-energized state by turning the power switch 12 from ON to OFF, the regenerative current I1 generated by the coil L1 flows along a path A4 to return to the coil L1. Along the path A4, the regenerative current I1 passes through the voltage regulator 34, the diode 33, and the load 32 in this order. Thus, the regenerative current I1 flows through, and is consumed by, the load 32. This allows the regenerative current I1 generated by the coil L1 to be reduced more quickly.

Figure 10:
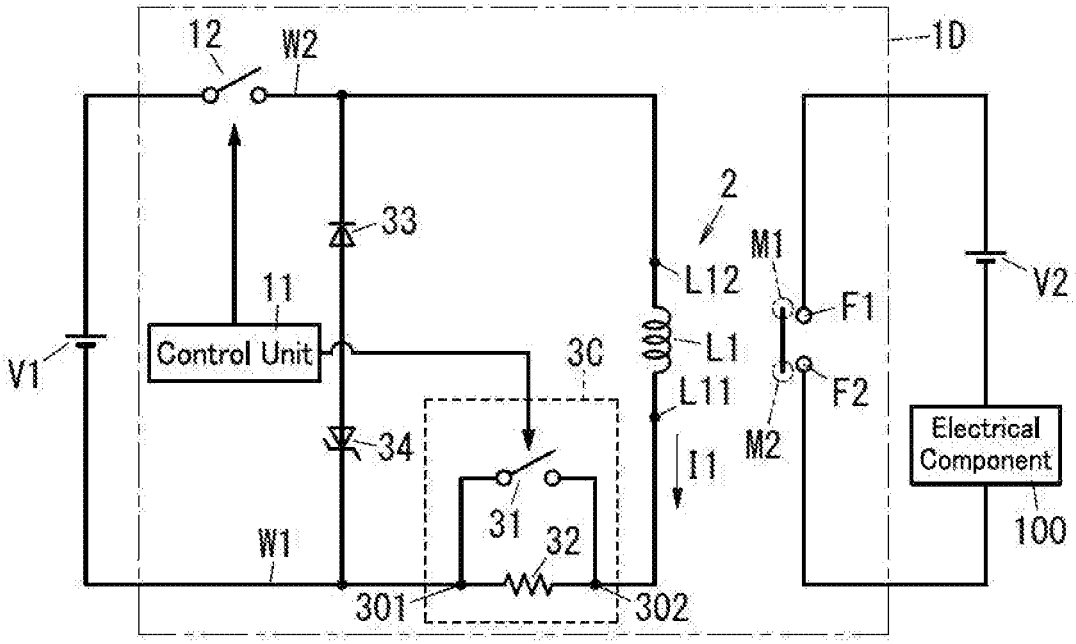
FIG. 10 is a circuit diagram of an electromagnetic relay according to a variation of the second embodiment.

FIG. 10 illustrates an electromagnetic relay 1D according to a variation of the second embodiment. As shown in FIG. 10, the parallel circuit of the switch 31 and the load 32 (regeneration unit 3C) may be electrically connected between the cathode of the voltage regulator 34 and a first terminal L11 of the coil L1 in series to the coil L1.

Optionally, the embodiments described above, as well as their variations, may be adopted in combination as appropriate.

REFERENCE SIGNS LIST

1, 1A, 1B, 1C, 1D Electromagnetic Relay
Electromagnet Device
3, 3A, 3B, 3C Regeneration Unit
4 Yoke
11 Control Unit
21 Mover
22 Stator
31 Switch
2 Load
33 Diode
34 Voltage Regulator
F1, F2 Fixed Contact
I1 Regenerative Current
L1 Coil
M1, M2 Moving Contact
V1 Power Supply
W2 Line

The invention claimed is:

1. An electromagnetic relay comprising:

a fixed contact;

a moving contact movable from a closed position where the moving contact is in contact with the fixed contact to an open position where the moving contact is out of contact with the fixed contact, and vice versa;

an electromagnet device including a coil and configured to move the moving contact from one of the closed position or the open position to the other position by having a magnetic flux generated by the coil when an electric current flows through the coil;

a regeneration unit including a switch and a load, the load being connected to the switch and configured to consume power when an electric current flows through the load, the regeneration unit being connected to the coil; and a control unit configured to control ON/OFF states of the switch, a regenerative current coming from the coil flowing through the regeneration unit when the coil makes a transition from an energized state where the coil is supplied with an electric current from a power supply to a non-energized state where the coil is supplied with no electric current from the power supply, the control unit being configured to cause the regenerative current to flow through the load by controlling the switch when the coil makes the transition from the energized state to the non-energized state, wherein the switch is connected to the load in parallel, the regeneration unit further includes a diode that is connected in series to a parallel circuit of the switch and the load, a cathode of the diode is to be connected to a high-potential line between the power supply and the coil, the regeneration unit is connected to the coil in parallel or in series, the regeneration unit further includes a voltage regulator connected in series to the parallel circuit of the switch and the load and to the diode, and the regenerative current flows through the voltage regulator when a counterelectromotive voltage of the coil is greater than a predetermined voltage.

2. The electromagnetic relay of claim 1, wherein the voltage regulator is a Zener diode.

3. The electromagnetic relay of claim 1, wherein the electromagnet device further includes:

a mover configured to move along with the moving contact;

a yoke configured to allow the magnetic flux generated by the coil to pass therethrough; and a stator, attractive force being produced between the mover and the stator by the magnetic flux generated by the coil, the attractive force causing the mover to move.

4. The electromagnetic relay of claim 1, wherein the load includes a resistor.

5. A method for controlling an electromagnetic relay, the electromagnetic relay including:

a fixed contact;

a moving contact movable from a closed position where the moving contact is in contact with the fixed contact to an open position where the moving contact is out of contact with the fixed contact, and vice versa;

an electromagnet device including a coil and configured to move the moving contact from one of the closed position or the open position to the other position by having a magnetic flux generated by the coil when an electric current flows through the coil; and a regeneration unit including a switch and a load connected to the switch and configured to consume power when an electric current flows through the load, the regeneration unit being connected to the coil, a regenerative current coming from the coil flowing through the regeneration unit when the coil makes a transition from an energized state where the coil is supplied with an electric current from a power supply to a non-energized state where the coil is supplied with no electric current from the power supply, the control method including causing the regenerative current to flow through the load by controlling the switch when the coil makes the transition from the energized state to the non-energized state, wherein the switch is connected to the load in parallel, the regeneration unit further includes a diode that is connected in series to a parallel circuit of the switch and the load, a cathode of the diode is to be connected to a high-potential line between the power supply and the coil, the regeneration unit is connected to the coil in parallel or in series, the regeneration unit further includes a voltage regulator connected in series to the parallel circuit of the switch and the load and to the diode, and the regenerative current flows through the voltage regulator when a counterelectromotive voltage of the coil is greater than a predetermined voltage.

* * * * *